US007237807B2

(12) United States Patent
Hiyama et al.

(10) Patent No.: US 7,237,807 B2
(45) Date of Patent: Jul. 3, 2007

(54) PIPE CONNECTING STRUCTURE FOR A HEAT EXCHANGER

(75) Inventors: Jinichi Hiyama, Tatebayashi (JP); Osamu Murata, Sano (JP); Masayoshi Shinhama, Sano (JP)

(73) Assignee: Calsonic Kansei Corporation (JP)

( * ) Notice: Subject to any disclaimer, the term of this patent is extended or adjusted under 35 U.S.C. 154(b) by 126 days.

(21) Appl. No.: 10/851,632

(22) Filed: May 21, 2004

(65) Prior Publication Data

US 2005/0275219 A1 Dec. 15, 2005

(30) Foreign Application Priority Data

May 21, 2003 (JP) ..... 2003-143459

(51) Int. Cl.
*F16L 5/00* (2006.01)

(52) U.S. Cl. ..... 285/141.1; 285/201; 285/208

(58) Field of Classification Search ..... 285/189, 285/201, 141.1, 148.28, 222, 208
See application file for complete search history.

(56) References Cited

U.S. PATENT DOCUMENTS 5,280,971 A * 1/1994 Tokutake et al. ..... 285/189
5,477,919 A * 12/1995 Karube ..... 165/176
5,524,938 A * 6/1996 Halder ..... 285/201
5,564,756 A * 10/1996 Hamilton ..... 285/222
5,911,274 A * 6/1999 Inaba et al. ..... 285/201
6,161,876 A * 12/2000 Sabathie ..... 285/222
6,347,663 B1 * 2/2002 Hunzinger et al. ..... 285/189

FOREIGN PATENT DOCUMENTS

| | | |
|---|---|---|
| JP | 05-318098 | 12/1993 |
| JP | 07-043094 | 2/1995 |
| JP | 09-280777 | 10/1997 |
| JP | 10-170190 | 6/1998 |

* cited by examiner

*Primary Examiner*—David Bochna
(74) *Attorney, Agent, or Firm*—Kilpatrick Stockton LLP

(57) ABSTRACT

A pipe connecting structure for a heat exchanger includes a header tank having a connect opening; a connector block having a passage configured to connect a pipe thereto; an adapter configured to connect the header tank and connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material applied to a joint area of the flange to be joined to the header tank and a joint area of the flange to be joined to the connector block, so as to join the header tank and connector block together by brazing.

6 Claims, 11 Drawing Sheets

PIPE CONNECTING STRUCTURE FOR A HEAT EXCHANGER

CROSS REFERENCE TO RELATED APPLICATIONS

This application is based upon and claims the benefit of priority from the prior Japanese Patent Application No. 2003-143459 filed on May 21, 2003, the entire contents of which are incorporated herein by reference.

BACKGROUND OF THE INVENTION

1. Field of the Invention

The present invention relates to a pipe connecting structure for a heat exchanger of, for example, a vehicle air conditioner.

2. Description of Related Art

An example of a heat exchanger is disclosed in Japanese Unexamined Patent Application Publication No. Hei-9-280777. The disclosed heat exchanger will be explained with reference to FIGS. 8 to 10.

The heat exchanger 1 has a pair of header tanks 2*a* and 2*b* facing each other and a plurality of flat tubes 3. Open ends of the flat tubes 3 are connected to the header tanks 2*a* and 2*b*, so that the tubes 3 and the header tanks 2*a* and 2*b* communicate with each other. The flat tubes 3 are arranged in multiple stages, and between the adjacent flat tubes 3, corrugated fins 4 are arranged.

Each of the header tanks 2*a* and 2*b* has a connector block 10, to connect an inlet or outlet pipe (not shown) to the header tanks 2*a* and 2*b*.

The connector block 10 has a through passage 12 to connect the pipe (not shown) to an opening 8 of the header tank 2*b* (2*a*). The passage 12 is provided with a boss 13, which protrudes from a connector block body 11 and is fitted into the connect opening 8 of the header tank 2*b* (2*a*). The boss 13 functions to position the connector block 10 relative to the header tank 2*b* (2*a*). The boss 13 is provided by a pipe member 14, which is separate component of the connector block body 11. The boss 13 is inserted into the body 11 and fixed thereto. Alternatively, the boss 13 may be machined from a base material that forms the connector block 10. A screw hole 15 is formed through the connector block 10, to fasten a flange of the pipe (not shown) to the connector block 10 with a screw.

The coolant flow in the heat exchanger 1 will be explained. A coolant is supplied to the header tank 2*a* from the inlet pipe through the connector block 10. The coolant flows through the tubes 3 between the header tanks 2*a* and 2*b* guided by partition plates (not shown) arranged in the header tanks 2*a* and 2*b*. When the coolant flows through the tubes 3, the coolant exchanges heat with air passing around the fins 4 between the tubes 3. Thereafter, the coolant is discharged from the header tank 2*b* to the outlet pipe through the connector block 10.

According to the related art, the base material that forms the connector block and/or the header tank is clad with a brazing material, and the connector block is fixed to the header tank by brazing. The cladding process increases the manufacturing cost of the pipe connecting structure. The term "clad" or "cladding" does not particularly specify a cladding method such as cladding by spraying or cladding by welding.

FIG. 11 shows other related art that directly fixes a pipe 16 to a header tank 2 (2*a*, 2*b*) by brazing. In this case, the header tank 2 and/or the pipe 16 are clad with a brazing material. The cladding process increases the manufacturing cost of the pipe connecting structure.

The present invention provides a pipe connecting structure for a heat exchanger. The connecting structure is capable of connecting a pipe to a header tank through a connector block without a brazing material on the header tank and the connector block.

The present invention provides a pipe connecting structure for a heat exchanger. The connecting structure is capable of directly connecting a pipe to a header tank without a brazing material on the header tank and the pipe.

SUMMARY OF THE INVENTION

A first aspect of the present invention provides a pipe connecting structure for a heat exchanger, including a header tank having a connect opening; a connector block having a passage configured to connect a pipe thereto; an adapter configured to connect the header tank and connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material applied to a joint area of the flange to be joined to the header tank and a joint area of the flange to be joined to the connector block, so as to join the header tank and connector block together by brazing.

A second aspect of the present invention provides a pipe connecting structure for a heat exchanger, including a header tank having a connect hole; a connector block having a passage configured to connect a pipe thereto; an adapter configured to connect the header tank and connector block to each other, the adapter having a first cylindrical part to be connected to the connect opening of the header tank, a second cylindrical part to be connected to the passage of the connector block, and a flange radially protruding between the first and second cylindrical parts and being interposed between joint areas of the header tank and connector block; and a brazing material applied to a joint area of the flange to be joined to the header tank and an area of the second cylindrical part to be connected to the connector block, so as to join the header tank and connector block together by brazing.

A third aspect of the present invention provides a pipe connecting structure for a heat exchanger, including a header tank having a connect opening; a connector block having a passage configured to connect a pipe thereto; an adapter configured to connect the header tank and connector block to each other, the adapter having a first cylindrical part to be connected to the connect opening of the header tank, a second cylindrical part to be connected to the passage of the connector block, and a flange radially protruding between the first and second cylindrical parts and being interposed between joint areas of the header tank and connector block; and a brazing material applied to a joint area of the flange to be joined to the header tank, a joint area of the flange to be joined to the connector block, and an area of the second cylindrical part to be connected to the connector block, so as to join the header tank and connector block together by brazing.

A fourth aspect of the present invention provides a pipe connecting structure for a heat exchanger, including a header tank having a connect opening; a connector block having a passage configured to connect a pipe thereto; an adapter configured to connect the header tank and connector block to each other, the adapter having a first cylindrical part to be connected to the connect opening of the header tank, a second cylindrical part having a larger diameter than the first cylindrical part, to be connected to the passage of the connector block, and a flange radially and continuously extending between the first and second cylindrical parts to form a step between the first and second cylindrical parts; and a brazing material applied to a joint area of the flange to be joined to the header tank and an area of the second cylindrical part to be connected to the connector block, so as to join the header tank and connector block together by brazing.

A fifth aspect of the present invention provides a pipe connecting structure for a heat exchanger, including a header tank having a connect opening; an adapter configured to connect the header tank and a pipe to each other, the adapter having a first cylindrical part to be connected to the connect opening of the header tank, a second cylindrical part to be internally or externally connected to the pipe, and a flange radially protruding between the first and second cylindrical parts and at least having a joint area to be joined to the header tank; and a brazing material applied to the joint area of the flange of the adapter to be joined to the header tank and a joint area of the adapter to be joined to the pipe, so as to join the header tank and pipe together by brazing.

According to the above-discussed aspects of the present invention, the adapter can fix, by brazing, the connector block to a predetermined location of the header tank. At this time, only the adapter is clad with a brazing material, and therefore, the area that is clad with the brazing material is very small compared with the related art that applies a brazing material to the header tank and/or the connector block and/or the pipe. Consequently, the present invention can reduce manufacturing costs.

DETAILED DESCRIPTION OF EMBODIMENTS

Preferred embodiments of the present invention will be explained with reference to the accompanying drawings. A general structure of a heat exchanger for which the embodiments are applied is the same as that explained in connection with the related arts, and further explanation is omitted.

First Embodiment

Figure 1:
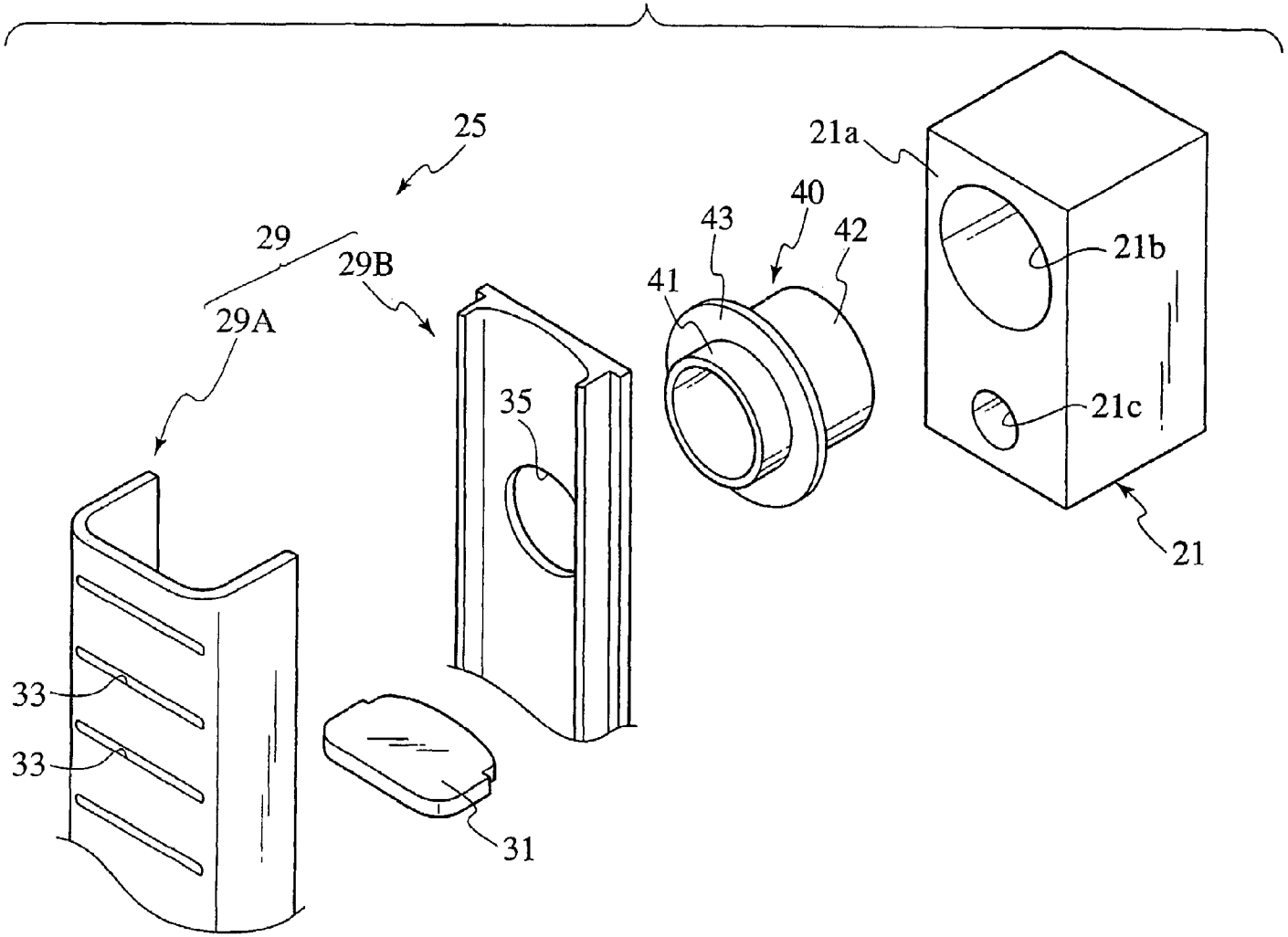
FIG. 1 is an exploded perspective view showing a pipe connecting structure for a heat exchanger according to a first embodiment of the present invention.
Figure 2:
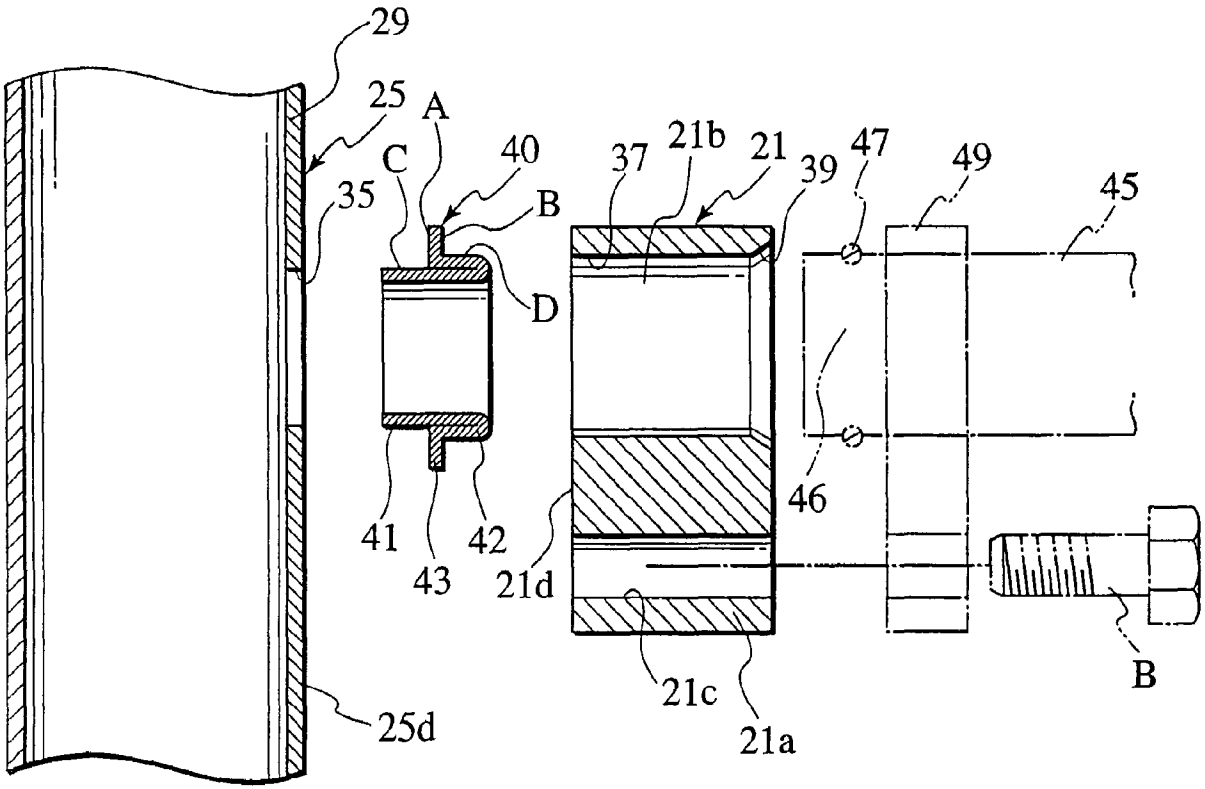
FIG. 2 is a longitudinal section showing the pipe connecting structure of FIG. 1.

FIGS. 1 and 2 show a pipe connecting structure for a heat exchanger according to the first embodiment of the present invention.

According to the pipe connecting structure of the first embodiment, a connector block 21 is fixed to a header tank 25 by an adapter 40 including a brazing material. A pipe 45 is connected to a passage 21*b* of the connector block 21, so that the pipe 45 can be connected to the header tank 25. The pipe connecting structure of the first embodiment will be explained in more detail.

The header tank 25 will be explained first.

The header tank 25 has a pipe 29 that is a combination of first and second longitudinal pipe members 29A and 29B, caps (not shown) to close each end opening of the pipe 29, and partition plates 31 to partition a longitudinal passage in the pipe 29. The pipe members 29A and 29B are formed by extruding a base material made of, for example, aluminum alloy. The first pipe member 29A has a channel-like sectional shape, and the second pipe member 29B has a flat shape serving as a lid to close the channel-like first pipe member 29A. The first and second pipe members 29A and 29B are assembled to form the pipe 29 having a substantially quadrate section. The first pipe member 29A has tube insertion openings 33 arranged in multiple stages. The second pipe member 29B has a connect opening 35 serving as an inlet or outlet for a coolant of the heat exchanger. The tube insertion openings 33 and connect opening 35 are formed by machining or pressing, for example.

The connector block 21 will be explained next.

The connector block 21 has a body 21*a*, the passage 21*b* formed through the body 21*a*, and a screw hole 21*c* formed through the body 21*a*. The passage 21*b* provides communication between the pipe 45 and the header tank 25. The screw hole 21*c* is used to fasten a flange 49 fixed to a connect end 46 of the pipe 45 to the connector block 21. An open end 37 of the passage 21*b* on the header tank side (the left side in FIG. 2) is fitted to the adapter 40. An open end 39 of the passage 21*b* on the pipe side (the right side in FIG. 2) is tapered to provide a guide face to receive the connect end 46 of the pipe 45.

Next, the adapter 40 will be explained.

The adapter 40 is formed by bending a portion of a straight tube so as to be folded back onto itself (FIG. 2). The strait tube is provided with a brazing material on the inner and outer faces thereof. The adapter 40 includes a first cylindrical part 41, a second cylindrical part 42, and 43 radially extending between the first and second cylindrical parts 41 and 42. The first cylindrical part 41 is fitted to the connect opening 35 of the header tank 25. The second cylindrical part 42 is fitted to the passage 21*b* of the connector block 21. The flange part 43 is interposed and sandwiched between a joint area 25*d* of the header tank 25 and a joint area 21*d* of the connector block 21.

The adapter 40 positions the connector block 21 relative to the connect opening 35 of the header tank 25. According to this embodiment, the flange part 43 has a joint area A that is clad with a brazing material and is joined to the joint area 25*d* of the header tank 25. The flange part 43 also has a joint area B that is clad with the brazing material and is joined to the joint area 21*d* of the connector block 21. The first cylindrical part 41 has an area C that is on an outer face of the first cylindrical part 41, and is clad with the brazing material. The area C is inserted into the opening 35 of the header tank 25. The second cylindrical part 42 has an area D that is on an outer face of the second cylindrical part 42, and is clad with the brazing material. The area D is inserted into the passage 37 of the connector block 21.

According to the first embodiment, the header tank 25 and connector block 21 are positioned and solidly fixed to each other by brazing through the adapter 40. According to the embodiment, only the adapter 40 is clad with a brazing material. Compared with the related arts in which the header tank 25 and/or the connector block 21 are clad with a brazing material, the first embodiment can greatly reduce a clad area and manufacturing costs.

The first embodiment fixes the header tank 25 and connector block 21 to each other by brazing through the adapter 40. In this embodiment, only the adapter 40 is clad with a brazing material. Compared with the related art that clads the header tank 25 and/or the connector block 21 with a brazing material, the first embodiment can greatly reduce a clad area and manufacturing costs.

Further, the first embodiments applies a brazing material to the joint area A, the joint area B, the area C, and the area D, for fixing the connector block 21 and header tank 25 together by brazing. These four areas clad with the brazing material serve to stably connect the connector block 21 and header tank 25 together.

Figure 3:
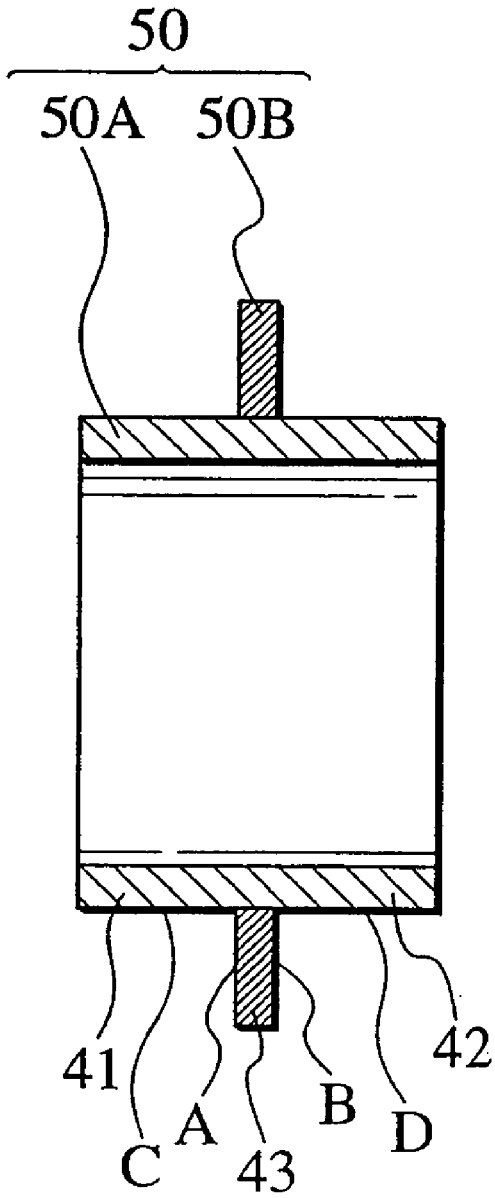
FIG. 3 is a sectional view showing an adapter according to a modification of the first embodiment.

FIG. 3 shows an adapter 50 according to a modification of the first embodiment.

Unlike the monolithic adapter 40 of FIGS. 1 and 2, the adapter 50 of FIG. 3 consists of two members 50A and 50B. More precisely, the straight cylindrical member 50A is an integration of the first and second cylindrical parts 41 and 42 of the first embodiment. The flange member 50B corresponds to the flange 43 of the first embodiment and is externally fitted to the cylindrical member 50A.

An outer face of the cylindrical member 50A is clad with a brazing material, and each face of the flange member 50B is clad with the brazing material. Like the adapter 40 of FIGS. 1 and 2, the adapter 50 has four areas clad with the brazing material. Namely, the brazing-material-clad areas of the adapter 50 are a joint area A of the plate part 43 to be joined to the header tank 25, a joint area B of the plate part 43 to be joined to the connector block 21, an area C on an outer face of the first cylindrical part 41 to be fitted to the header tank 25, and an area D on an outer face of the second cylindrical part 42 to be fitted to the connector block 21.

The adapter 50 of FIG. 3 provides the same effects as the adapter 40 of FIGS. 1 and 2. In terms of manufacturing costs, the adapter 40 of FIGS. 1 and 2 is more preferable.

Second Embodiment

Figure 4:
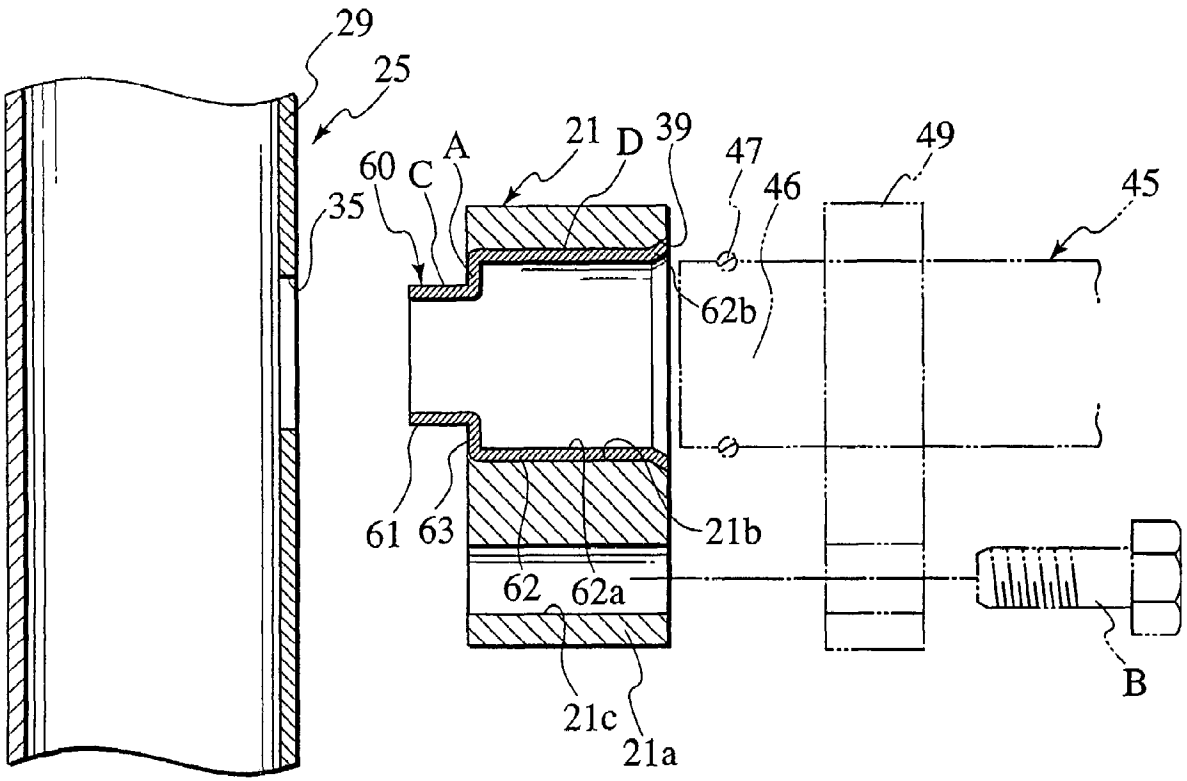
FIG. 4 is a longitudinal section showing a pipe connecting structure for a heat exchanger according to a second embodiment of the present invention.

FIG. 4 shows a pipe connecting structure for a heat exchanger according to the second embodiment of the present invention. Parts of the second embodiment equivalent to those of the first embodiment are represented with like reference numerals and an explanation thereof is omitted.

The pipe connection structure of the second embodiment and resembles the first embodiment in connecting a pipe 45 to a header tank 25 with the use of a connector block 21. An adapter 60 of the second embodiment, however, differs from the adapter 40 of the first embodiment. According to the second embodiment, the adapter 60 has a first cylindrical part 61 having a small diameter, a second cylindrical part 62 having a large diameter, and a flange 63 serving as a step between the first and second cylindrical parts 61 and 62. The first and second cylindrical parts 61 and 62 are continuous to each other through the flange 63. The second cylindrical part 62 has an inner face 62*a* serving as a seal face tightly fitted to an O-ring (seal) 47 arranged at a connect end 46 of the pipe 45. The second cylindrical part 62 has an open end 62*b*, which is tapered to conform to a guide face 39 of a passage 21*b* formed through the connector block 21. The open end 62*b* serves as a stopper to provide a fixed position of the adapter 60 relative to the connector block 21.

The inner face 62*a* of the adapter 60 does not include brazing material, and an outer face thereof is clad with a brazing material. Namely, the brazing material covers an area C of the first cylindrical part 61 to be connected to a connect opening 35 of the header tank 25, a joint area A of the flange 63 to be joined to the header tank 25, and an area D of the second cylindrical part 62 to be connected to the passage 21*b* of the connector block 21.

Like the first embodiment, the second embodiment securely connects and positions the header tank 25 and connector block 21 together by brazing through the adapter 60. According to the second embodiment, only the adapter 60 is clad with a brazing material. Compared with the related art that clads the header tank 25 and/or the connector block 21 with a brazing material, the embodiment can greatly reduce a clad area and manufacturing costs.

According to the second embodiment, at least the joint area A of the flange 63 to be joined to the header tank 25 and the area D of the second cylindrical part 62 to be connected to the passage 21*b* of the connector block 21 must be clad with a brazing material. As discussed above, the area C of the first cylindrical part 61 to be connected to the header tank 25 may also be clad with the brazing material provide a secure connection between the header tank 25 and the connector block 21.

Third Embodiment

Figure 5:
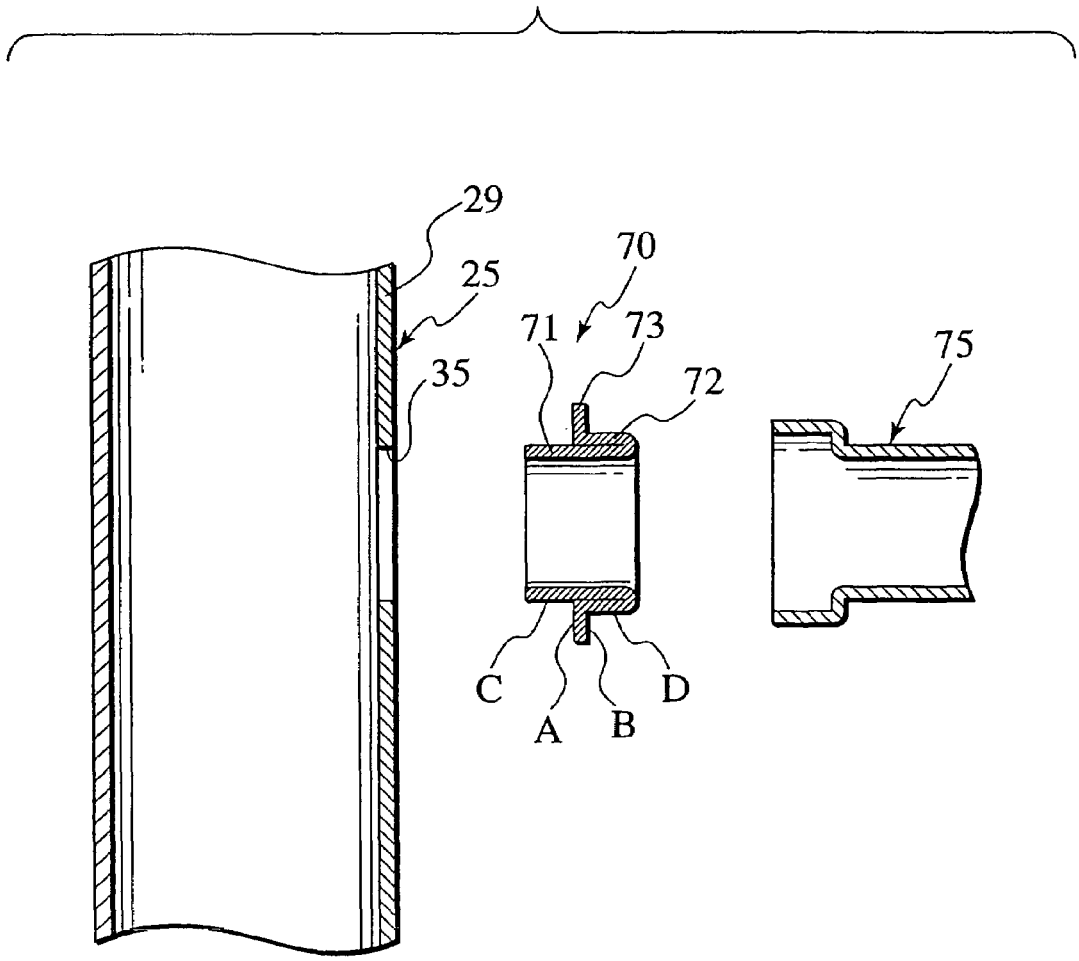
FIG. 5 is a longitudinal section showing a pipe connecting structure for a heat exchanger according to a third embodiment of the present invention.

FIG. 5 shows a pipe connecting structure for a heat exchanger according to the third embodiment of the present invention.

The third embodiment differs from the first and second embodiments in that the third embodiment does not require a connector block. Namely, the third embodiment connects a pipe 75 to a connect opening 35 of a header tank 25 by brazing through an adapter 70.

The adapter 70 of the third embodiment has the same shape as the adapter 40 shown in FIGS. 1 and 2. The adapter 70 has a first cylindrical part 71 to be connected to the connect opening 35 of the header tank 25, a second cylindrical part 72 to which the pipe 75 is externally connected, and a flange 73 radially extending between the first and second cylindrical parts 71 and 72 and has a joint area A to be joined to the header tank 25.

Like the first embodiment, the adapter 70 of the third embodiment is formed by bending back a straight tube having a brazing material on the inner and outer faces thereof. The inner and outer faces of the adapter 70 are clad with the brazing material. The brazing material covers the joint area A of the flange 73 of the adapter 70 to be joined to the header tank 25 and a joint area D on the outer face of the second cylindrical part 72 of the adapter 70 to be joined to the pipe 75. As a result, the header tank 25 and pipe 75 are connected together by brazing through the adapter 70.

According to the third embodiment, the adapter 70 can connect the pipe 75 to a predetermined location on the header tank 25 by brazing. According to the embodiment, only the adapter 70 is clad with a brazing material. Compared with the related art that clads the header tank 25 and/or the pipe 75 with a brazing material, the embodiment can greatly reduce a clad area and manufacturing costs.

Figure 6:
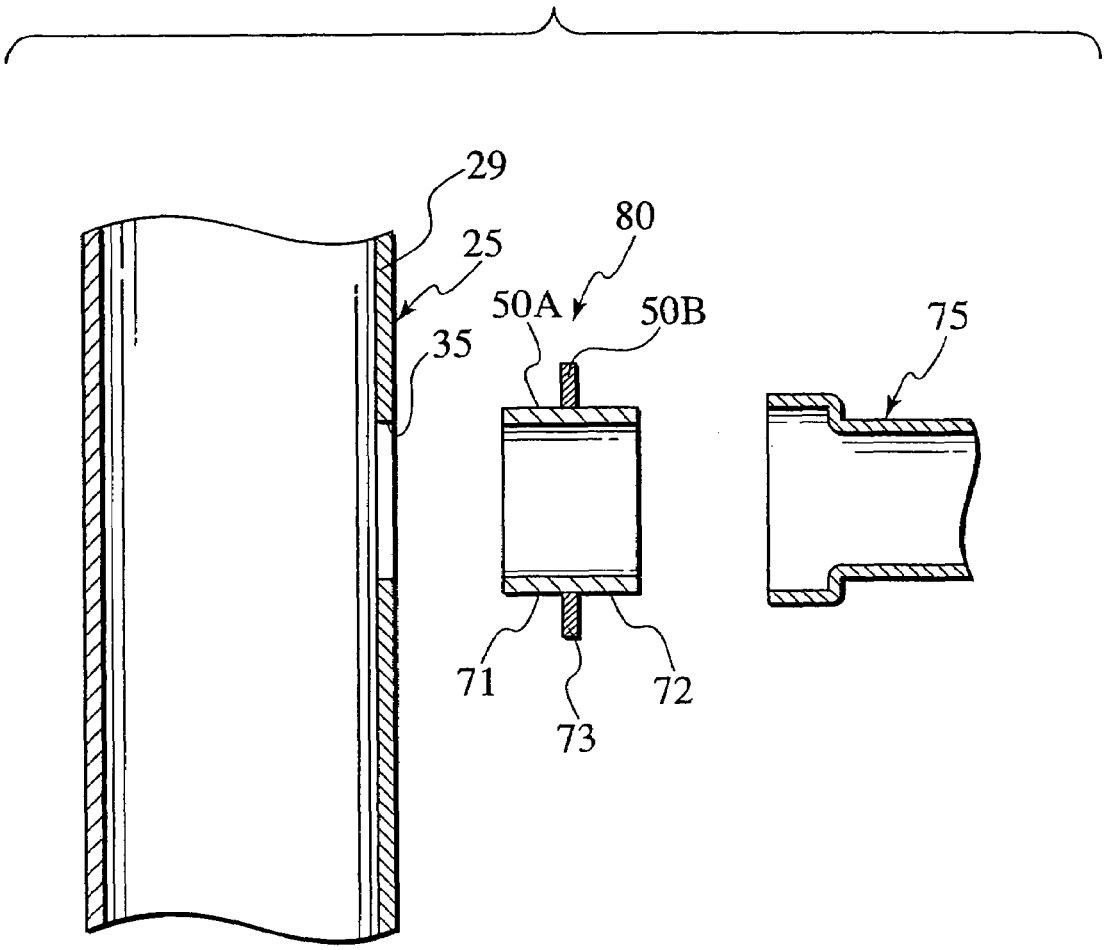
FIG. 6 is a longitudinal section showing a modification of the third embodiment.

FIG. 6 shows an adapter 80 according to a modification of the third embodiment. The adapter 80 has the same shape as the adapter 50 of FIG. 3 and can be used in place of the adapter 70 of FIG. 5.

Fourth Embodiment

Figure 7:
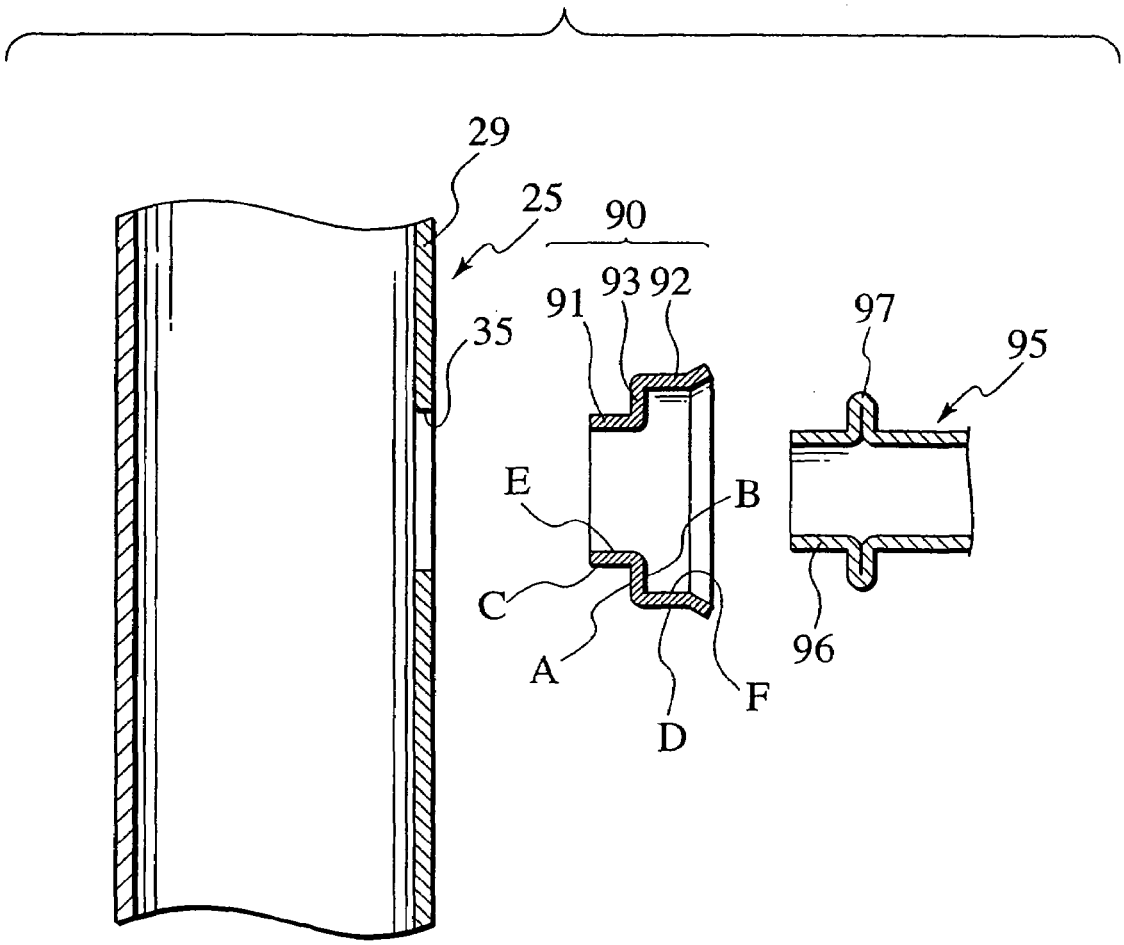
FIG. 7 is a longitudinal section showing a pipe connecting structure for a heat exchanger according to a fourth embodiment of the present invention.
Figure 8:
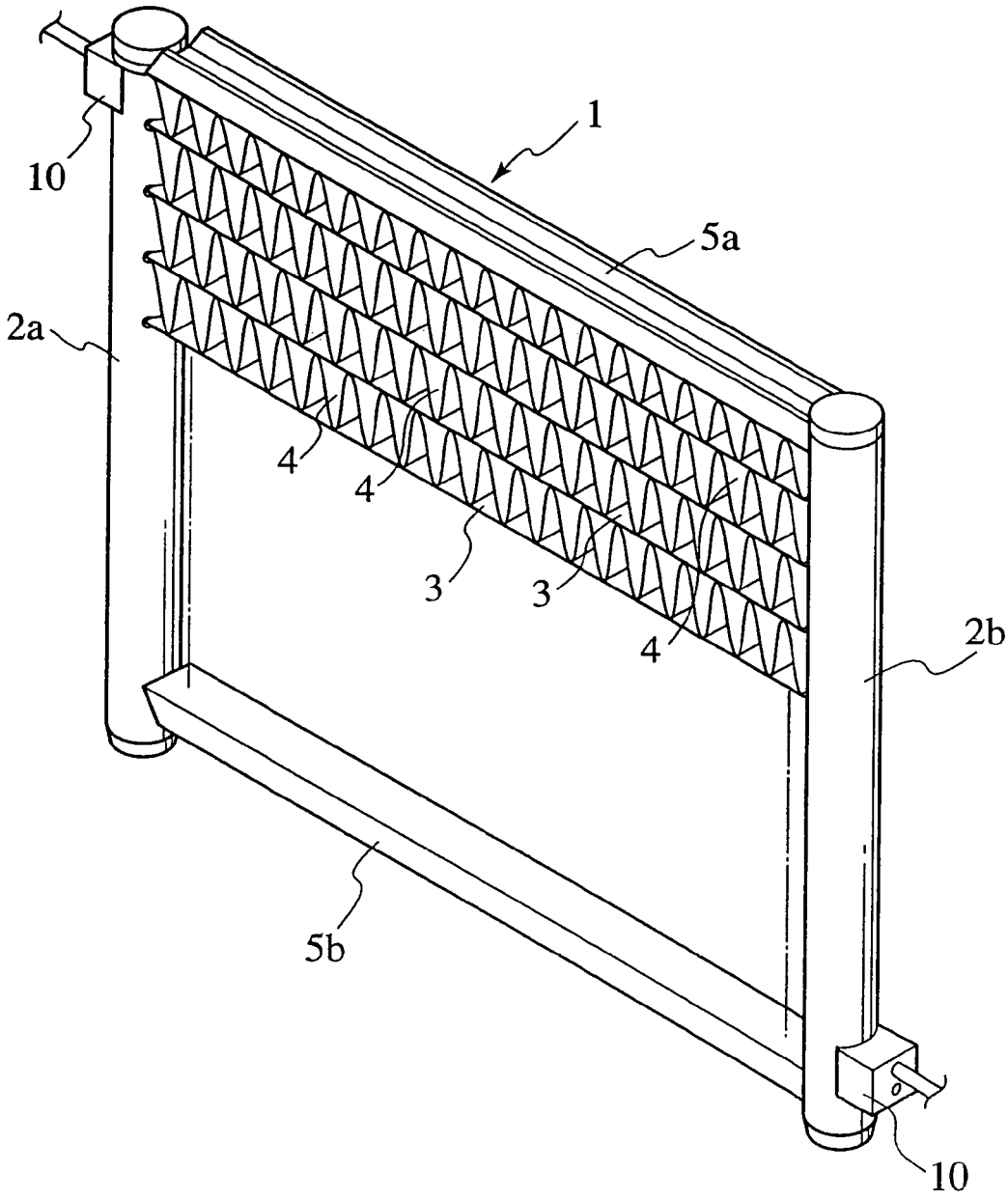
FIG. 8 is a general perspective view showing a heat exchanger (condenser) according to a related art.
Figure 9:
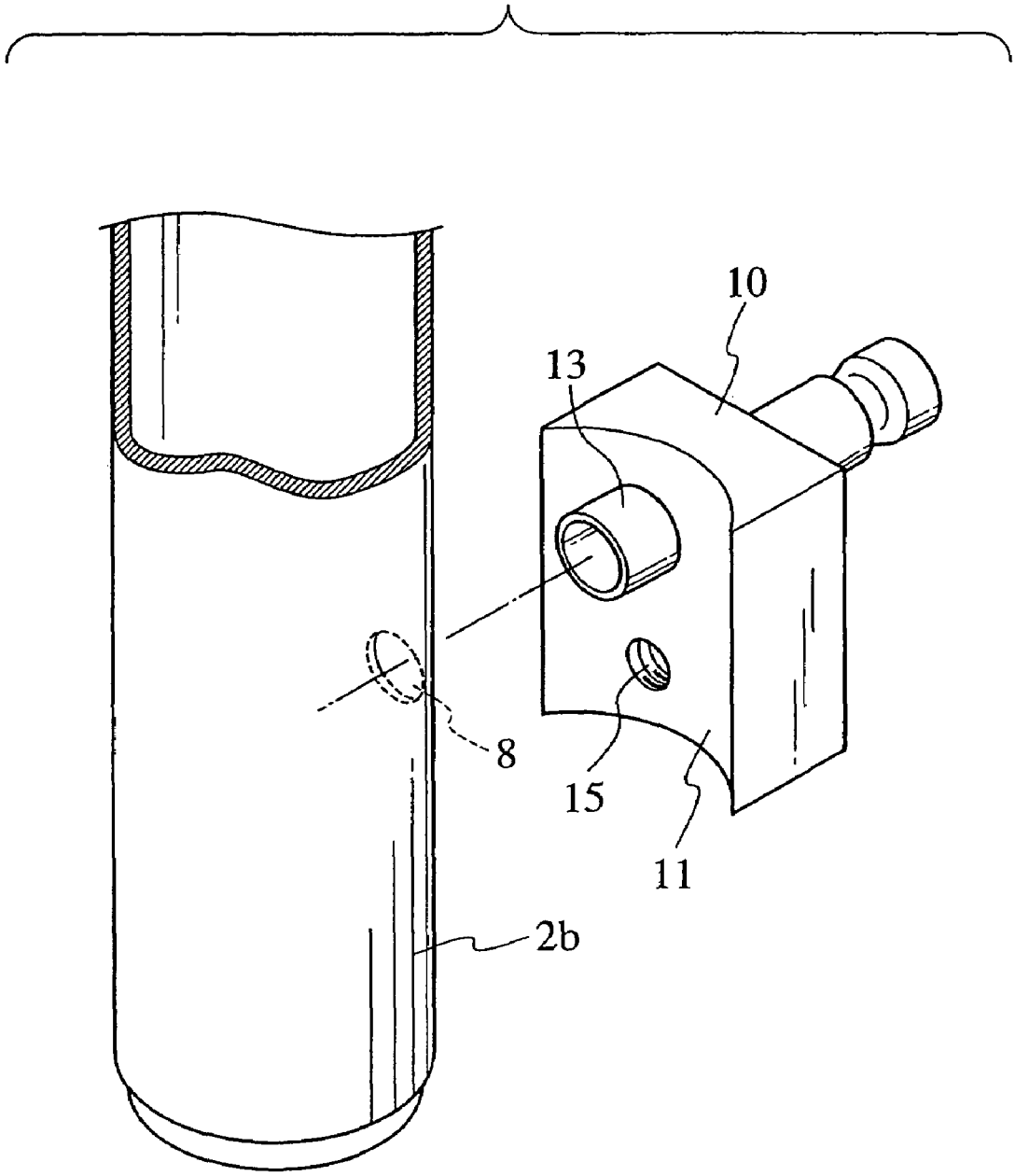
FIG. 9 is an enlarged perspective view partly showing a pipe connecting structure for the heat exchanger of FIG. 8.
Figure 10:
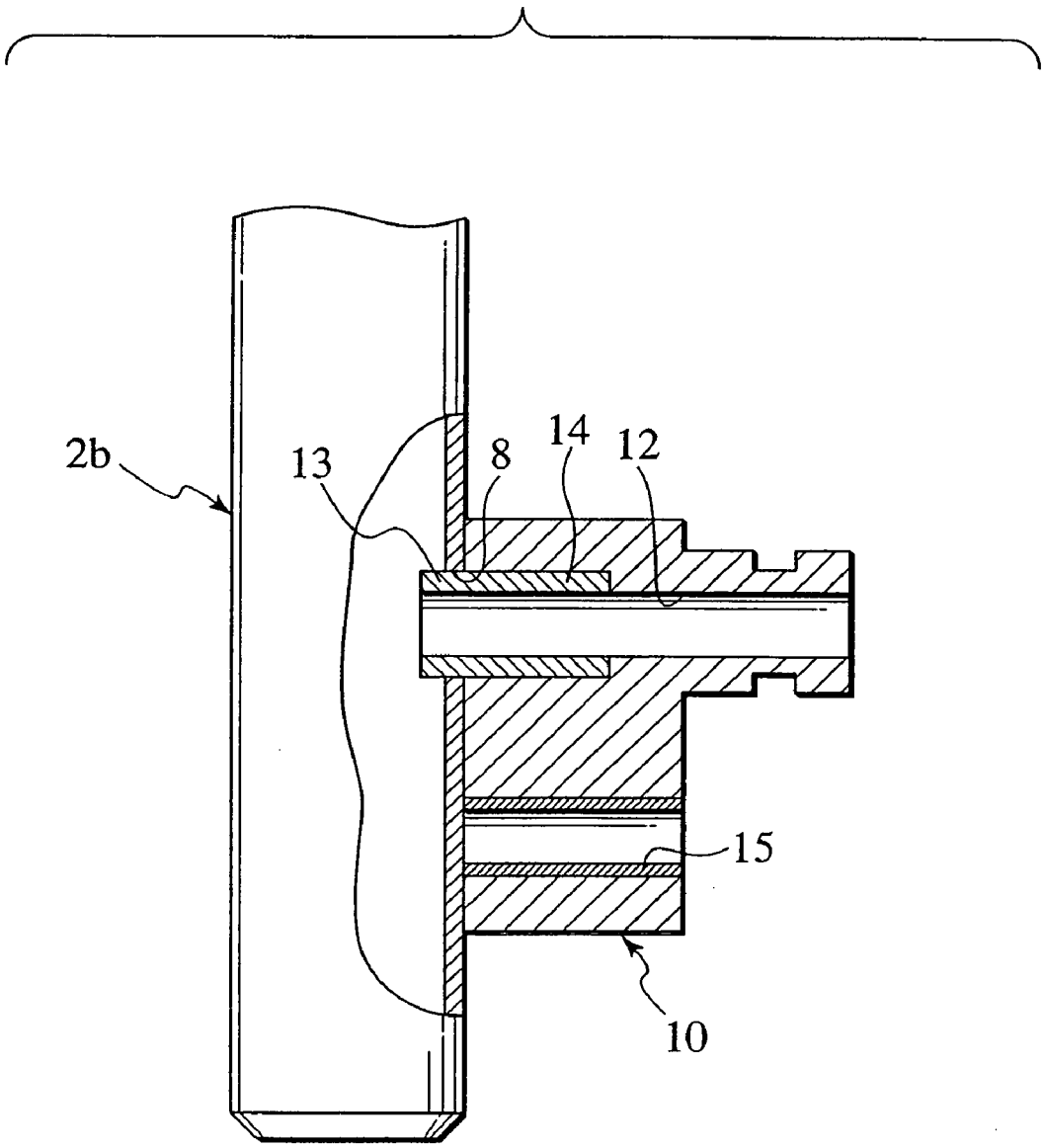
FIG. 10 is a partly broken front view showing the pipe connecting structure of FIG. 9.
Figure 11:
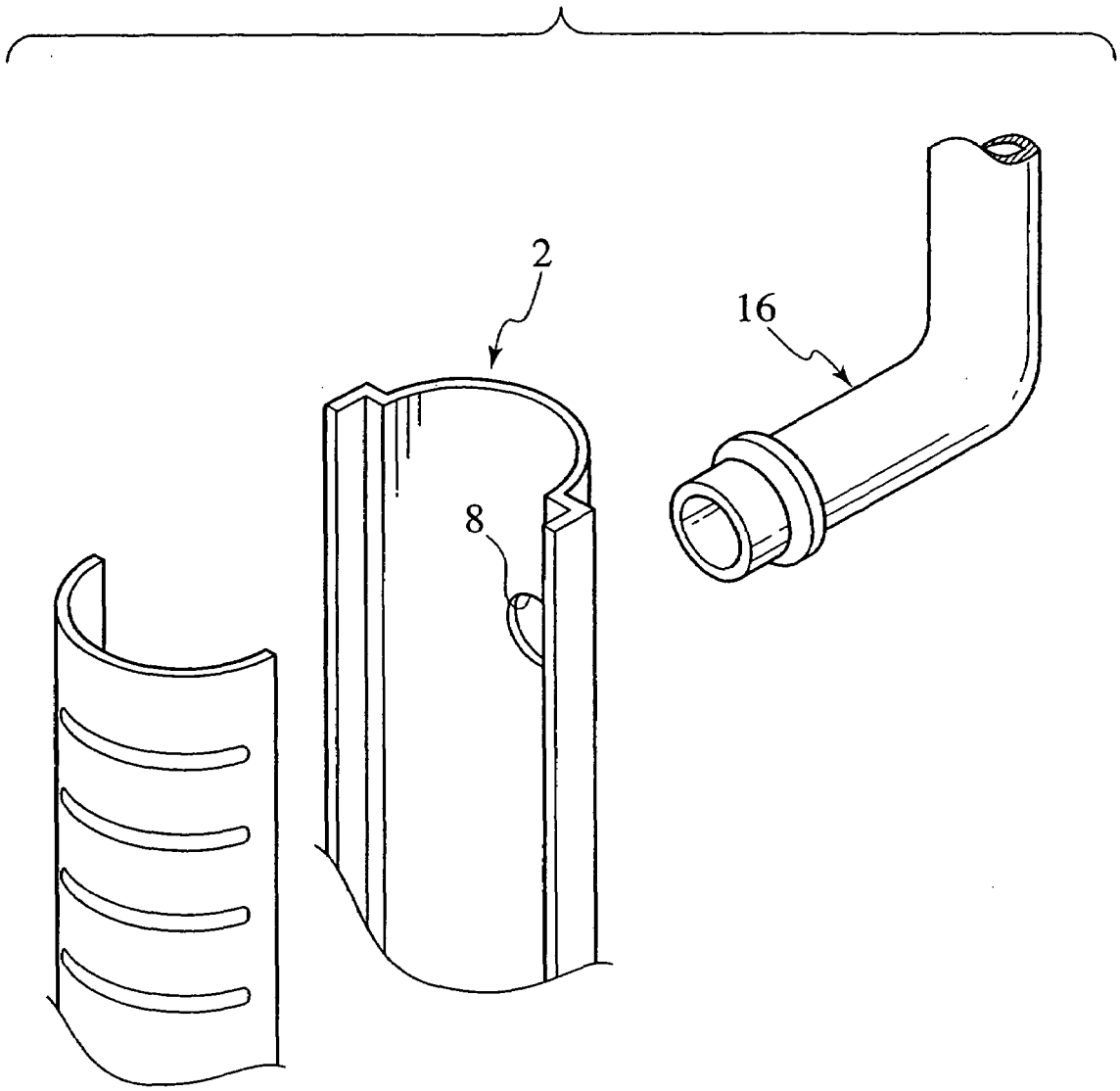
FIG. 11 is an exploded perspective view showing a pipe connecting structure according to another related art.

FIG. 7 shows a pipe connecting structure for a heat exchanger according to the fourth embodiment of the present invention.

The fourth embodiment resembles the third embodiment in that a pipe 95 is fixed to a connect opening 35 of a header tank 25 by brazing through an adapter 90. The fourth embodiment differs from the third embodiment in that the pipe 95 is internally connected to a second cylindrical part 92 of the adapter 90, unlike the third embodiment that externally connects the pipe 75 to the second cylindrical part 72 of the adapter 70.

More precisely, the adapter 90 according to the fourth embodiment comprises the small-diameter first cylindrical part 91, a flange 93 forming a step, and the large-diameter second cylindrical part 92. These parts 91, 93, and 92 are integrally formed. The first cylindrical part 91 is connected to the connect opening 35 of the header tank 25, and the second cylindrical part 92 internally receives a flange 97 formed at a connect end 96 of the pipe 95. An outer face of the flange 93 is a joint area A to be joined to the header tank 25, and an inner face of the flange 93 is a joint area B to be joined to the flange 97 of the pipe 95. The flange 93 is sandwiched between the header tank 25 and the flange 97 of the pipe 95.

Inner and outer faces of the adapter 90 are clad with a brazing material. The brazing material at least covers minimum required locations including the joint area A of the flange 93 of the adapter 90 to be joined to the header tank 25 and the joint area B (and/or a joint area E and/or a joint area F) of the adapter 90 to be joined to the pipe 95. As a result, the header tank 25 and pipe 95 are fixed together by brazing through the adapter 90.

The fourth embodiment provides the same effects as the third embodiment. According to the fourth embodiment, the inner face of the flange 93 of the adapter 90 is the joint area B to be joined to the flange 97. The fourth embodiment includes more brazing joint areas than the third embodiment, to further stabilize the connection by brazing.

Although the present invention has been explained in detail with reference to the embodiments, it must be understood that these embodiments are not intended to limit the present invention. As is apparent for those skilled in the art, the present invention allows many alterations and modifications without departing from the spirit and scope thereof defined in the appended claims. Accordingly, the descriptions in this specification are provided only for an explanatory purpose and are not intended to restrict the present invention.

What is claimed is:

1. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank and a joint area of the flange to be joined to the connector block, so as to join the header tank and connector block together by brazing, wherein the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion.

2. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank and an area of the second cylindrical part to be connected to the connector block, so as to join the header tank and connector block together by brazing, wherein the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion.

3. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank, a joint area of the flange to be joined to the connector block, and an area of the second cylindrical part to be connected to the connector block, to join the header tank and connector block together by brazing, wherein the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion.

4. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank and a joint area of the flange to be joined to the connector block, so as to join the header tank and connector block together by brazing, wherein the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion, and wherein the brazing material is also applied to an area of the first cylindrical part to be connected to the header tank.

5. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank and an area of the second cylindrical part to be connected to the connector block, so as to join the header tank and connector block together by brazing, wherein the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion, and wherein the brazing material is also applied to an area of the first cylindrical part to be connected to the header tank.

6. A set of pipe connecting structures for a heat exchanger, comprising:

a header tank having a connect opening that is uncladded with brazing material;

a connector block having a passage configured to connect a pipe thereto;

an adapter configured to connect the header tank and the connector block to each other, the adapter having a first cylindrical part to be connected to the connect opening of the header tank, a second cylindrical part to be connected to the passage of the connector block, and a flange radially extending between the first and second cylindrical parts and being interposed between joint areas of the header tank and connector block; and a brazing material clad to a joint area of the flange to be joined to the header tank, a joint area of the flange to be joined to the connector block, and an area of the second cylindrical part to be connected to the connector block, to join the header tank and connector block together by brazing, the adapter is formed by bending a straight cylindrical material that has brazing materials on inside and outside thereof, the adapter having an inner cylindrical portion, an outer cylindrical portion that is folded back onto an outside of the inner cylindrical portion, and a flange portion extending radially outwardly from the outer cylindrical portion, and wherein the brazing material is also applied to an area of the first cylindrical part to be connected to the header tank.

* * * * *